US006285289B1

(12) United States Patent
Thornblad

(10) Patent No.: US 6,285,289 B1
(45) Date of Patent: Sep. 4, 2001

(54) SMOKE DETECTOR WRIST KIDNAPPER ALARM

(76) Inventor: Joe Thornblad, 2100 Shepherd Dr., St. Peter, MN (US) 50682

( * ) Notice: Subject to any disclaimer, the term of this patent is extended or adjusted under 35 U.S.C. 154(b) by 0 days.

(21) Appl. No.: 09/748,439

(22) Filed: Dec. 27, 2000

(51) Int. Cl.[7] ..... G08B 17/10; G08B 23/00

(52) U.S. Cl. ..... 340/628; 340/539; 340/577; 340/693.6; 368/11

(58) Field of Search ..... 340/577, 578, 340/579, 628, 629, 630, 693.5, 693.6, 539; 368/11

(56) References Cited

U.S. PATENT DOCUMENTS

| | | | |
|---|---|---|---|
| D. 275,375 | | 9/1984 | Schartz . |
| D. 389,077 | | 1/1998 | Miranda, Jr. . |
| 4,540,980 | | 9/1985 | Porco . |
| 4,796,015 | | 1/1989 | Admire, Jr. . |
| 4,862,141 | | 8/1989 | Jordal . |
| 4,949,077 | * | 8/1990 | Mbuthia ..... 340/628 |
| 5,115,223 | | 5/1992 | Moody . |
| 5,119,072 | | 6/1992 | Hemingway . |
| 5,243,329 | | 9/1993 | Happer, Jr. . |
| 5,258,746 | | 11/1993 | Leitten et al. . |
| 5,309,145 | | 5/1994 | Branch et al. . |
| 5,420,570 | | 5/1995 | Leitten et al. . |
| 5,574,433 | | 11/1996 | Bahcall . |
| 5,604,483 | | 2/1997 | Giangardella . |
| 5,867,105 | * | 2/1999 | Hajel ..... 340/628 |

* cited by examiner

*Primary Examiner*—Daniel J. Wu
(74) *Attorney, Agent, or Firm*—Tipton L. Randall

(57) ABSTRACT

A self contained, wearable personal protection device that incorporates a silent security alarm feature, a smoke detector alarm feature and, optionally, the feature of providing the time of day to the wearer is disclosed. The personal protection device with these features is incorporated into a housing case that is sized to be worn about the wrist of an individual user. The personal protection device is particularly suited for use by children. The smoke detector alarm feature of the device automatically activates an audible alarm feature when smoke is detected. The silent security alarm feature is activated when the wearer pushes a button on the device. Further, the wrist worn personal protection device optionally provides the wearer with the time of day as a further incentive for the child to wear the device.

20 Claims, 5 Drawing Sheets

SIDE VIEW

FRONT VIEW

SMOKE DETECTOR WRIST KIDNAPPER ALARM

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a device that provides a personal security alarm, a smoke alarm and a time of day output, and more particularly, to such a device that is wearable by an individual.

2. Background Information

The subject matter of this invention is directed primarily to a wearable security device that provides protection to the wearer from a variety of perils.

Personal security devices that produce a loud alarm signal are well known to discourage would-be assailants. For such alarm units to be effective, they must be carried to be accessible at a moment's notice. Remembering to carry the alarm on a regular basis can be difficult, and holding the alarm in one's hand for immediate availability is awkward and burdensome.

Smoke alarms to detect smoke particles or similar combustion products are standard devices placed within all types of buildings. The smoke alarm produces a loud alarm signal to warn individuals of the presence of fire in or around the structure.

Some examples of novel personal security devices and novel smoke alarm devices are disclosed in the following patents.

In U.S. Pat. No. 4,540,980 Porco discloses a portable room security alarm that includes a smoke detector alarm, a motion sensing intrusion alarm, a temperature sensing alarm, and a digital display alarm clock. The device has a clip for mounting the device at the top of a door and a temperature sensing probe that attaches to the clip or door hardware to indicate hot surfaces produced by a fire.

Admire, Jr., in U.S. Pat. No. 4,796,015 describes a combination clock and smoke alarm in which cessation of clock operation indicates inoperativeness of the smoke alarm. The smoke alarm structure is concealed from view by the clock face.

In U.S. Pat. No. 4,862,141, Jordal discloses an integrated smoke and intrusion alarm system for windows, doors and other openings in exterior building walls. The device is powered by a solar battery.

Moody, in U.S. Pat. No. 5,115,223, describes a system for monitoring the location of an individual that includes a band attached to the individual that has a pressure actuated tamper indicator and a monitoring/tracking unit that may be used to both monitor whether the individual has left a predetermined area and provides an indication of the direction to the individual.

In U.S. Pat. No. 5,119,072, Hemingway discloses an apparatus for monitoring a child that includes a transmitter having a microphone and an oscillator coupled to an antenna within an enclosure for mounting on a child's arm and transmitting a radio signal from the antenna. A separate receiver receives the radio signal and when the signal strengths drop to a predetermined level, the receiver sounds an alarm to warn an adult of the situation.

Haper, Jr., in U.S. Pat. No. 5,243,329, describes a device in the shape of a wrist watch that includes an electronic circuit that senses smoke and provides an alarm to those in the vicinity of the device. The alarm allows easy location of the device when worn by an individual. The device further includes the feature of providing the time of day to the wearer.

In U.S. Pat. Nos. 5,258,746 and 5,420,570, Leitten et al. disclose a personal alarm which can be manually actuated to produce a high-intensity sonic alarm signal. The alarm device is incorporated into a wrist watch or similar article worn on the body of a user to be protected. The device provides a tuned warbling signal using a piezoelectric transducer.

Branch et al., in U.S. Pat. No. 5,309,145, describe a travel device that includes a clock, a lamp, an alarm, a motion detector and a smoke alarm to provide the user with both convenience and security when traveling. The clock and alarm interact to provide an alarm clock.

In U.S. Pat. No. 5,574,433, Bahcall discloses a personal security alarm combined with a wrist watch to be readily accessible on a user's wrist in an emergency situation. An exposed activation button has a large surface for easy activation, and a reset button hidden on the underside of the device to require removal of a buckle fastener before resetting the alarm.

Giangardella et al., in U.S. Pat. No. 5,604,483, describe a portable battery operated personal alarm and motion detector having two passive infrared elements for sensing motion, plus a smoke detector and a manually armed alarm mode where pressing a button emits a high decibel alarm.

A portable security alarm is shown by Schwartz in Des. 275,375, while a wrist alarm is shown by Miranda, Jr. in Des. 389,077. No specific details are provided for these design inventions.

Thus, there is an unmet need for a wearable device that incorporates a personal security alarm feature, a smoke alarm detector feature, and the feature of providing the time of day to the wearer.

SUMMARY OF THE INVENTION

The invention is a personal protection device for attachment to an individual. The device has a housing case member including a cylindrical, flat member having front and back surfaces and a peripheral side surface. The housing case member has an access opening on the cylindrical flat member back surface to a battery compartment therein, with a battery power source member within the battery compartment. There is a strap member for attachment of the housing case member to an individual. A smoke detector member is present within the housing case member and powered by the battery power source. There is an audible alarm generating member within the housing case member also powered by the battery power source, with the audible alarm generating member actuated by the smoke detector member. Also present is a personal alarm actuating button member on the housing case member which actuates a silent alarm generating member which is powered by the battery power source.

The silent alarm generated includes a trackable radio signal. An alarm deactivating button member is present on the housing case member which deactivates both the silent alarm generating member and the audible alarm generating member. An optional electric clock mechanism member may be present within the housing case member. The electric clock mechanism member has a time display means, with the clock mechanism member powered by the battery power source member. The clock mechanism member also has a control switch positioned on the peripheral side surface of the housing case member.

DESCRIPTION OF THE PREFERRED EMBODIMENTS

Nomenclature

10 Personal Protection Device

15 Cylindrical Housing Case Member

20 Front Surface of Case Member

25 Back Surface of Case Member

30 Peripheral Side Surface of Case Member

35 Battery Compartment

40 Battery Power Source Member

45 Access Opening to Battery Compartment

50 Strap Member

55 Strap Fastener Member

60 Strap Member First End

65 Strap Member Second End

70 Smoke Detector Member

75 Audible Alarm Generating Member

80 Protective Grating Member

85 Silent Alarm Generating Member Activation Button

90 Silent Alarm Generating Member

95 Alarm Generating Member Deactivation Button

100 Clock Mechanism

105 Time of Day Display

110 Clock Mechanism Control Switch Member

Construction

The device of the present invention is a self contained, wearable personal protection device that incorporates a silent security alarm feature, a smoke detector alarm feature, and optionally, the feature of providing the time of day to the wearer. The personal protection device with these features is incorporated into a housing case that is sized to be worn about the wrist of an individual user. The personal protection device is particularly suited for use by children. The child may be the subject of attack by, for instance, a kidnapper where the child can activate the silent security alarm feature. The silent security alarm feature includes the generation of a trackable radio signal that enables authorities to determine the location of the individual wearing the device. The smoke detector alarm feature of the device automatically activates the audible alarm feature when smoke is detected. This warns the child to flee the area, Should the child be frightened and hide in a burning structure, or be unable to flee because of injury or the like, the automatic smoke detector alarm feature assists rescuers in locating the child. Both the silent alarm and the audible alarm can be deactivated by pushing a deactivation button on the device. Further, the wrist worn personal protection device optionally provides the wearer with the time of day as a further incentive for the child to wear the device.

Figure 1:
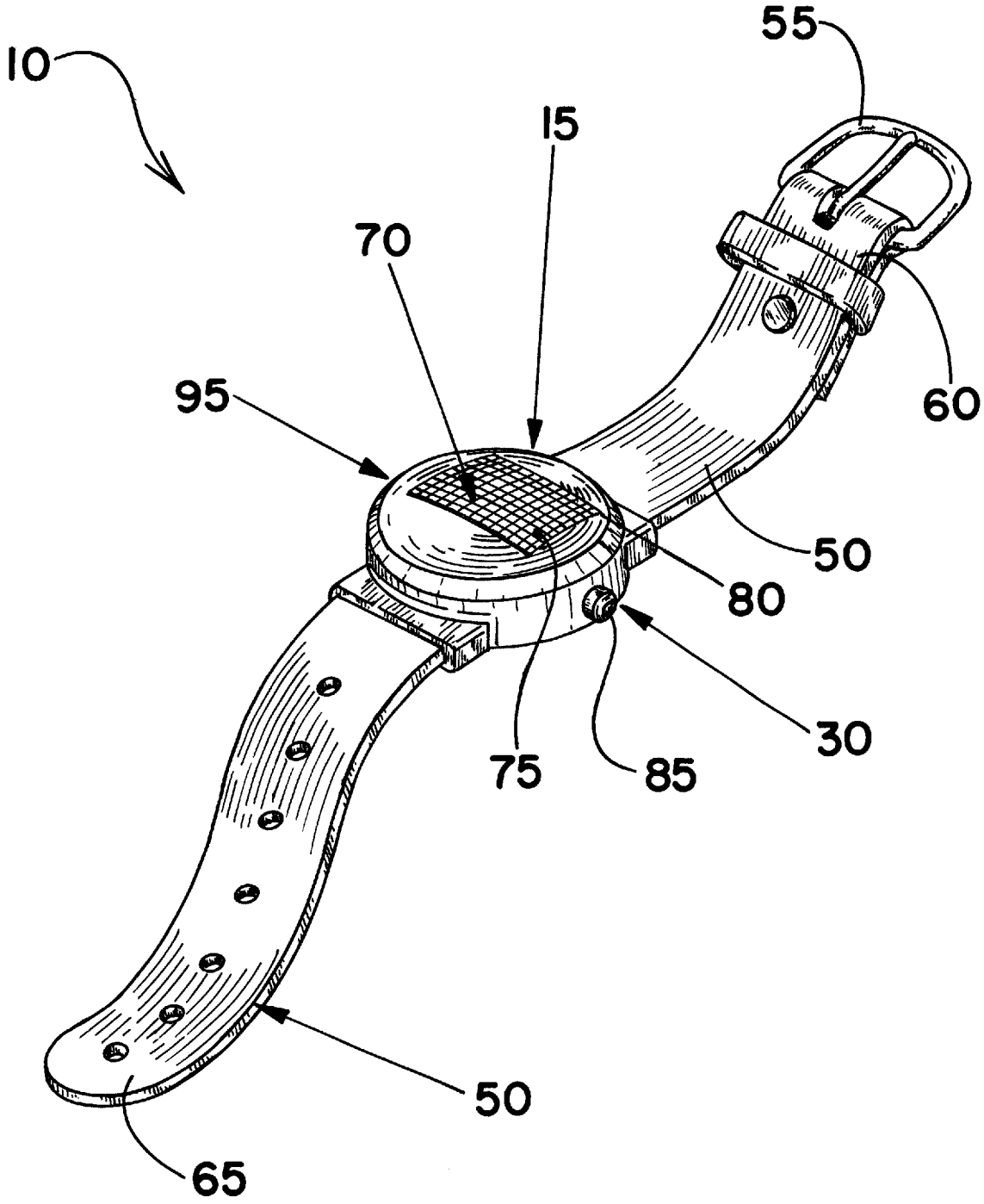
FIG. 1 is a perspective view of a preferred embodiment of the of the present invention.
Figure 3:
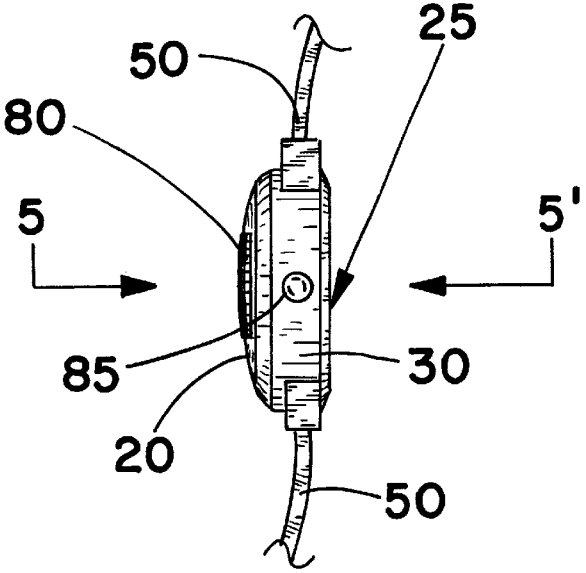
FIG. 3 is a side view of the preferred embodiment of the of the present invention.
Figure 2:
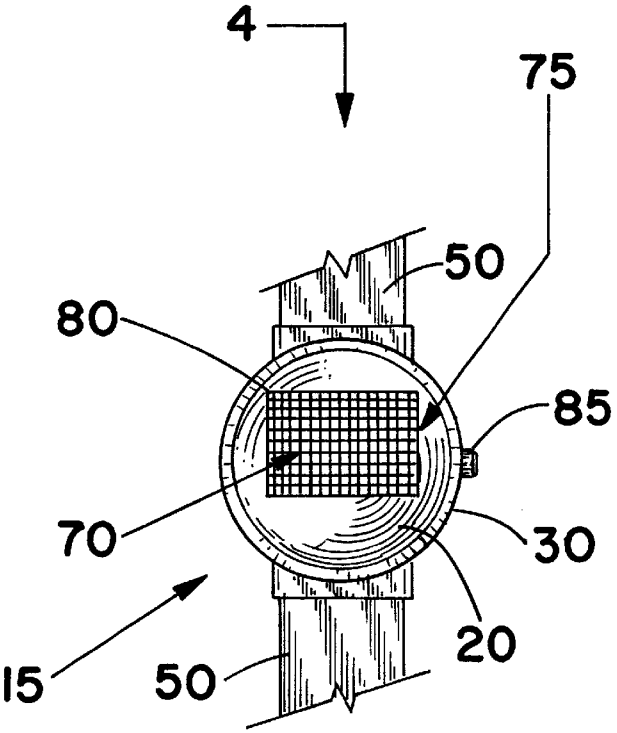
FIG. 2 is a front view of the preferred embodiment of the of the present invention.

Referring to FIGS. 1–3, the preferred embodiment of the personal protection device is shown. The personal protection device 10 for attachment to an individual comprises a housing case member 15, including a cylindrical, flat member having front 20 and back 30 surfaces and a peripheral side surface 30. The housing case member 15 has an access opening 45 on the cylindrical flat member back surface 25 to a battery compartment 35 contained therein. A battery power source member 40 is positioned within the battery compartment 35 and provides power to all components of the device. A strap member 50 is secured to the housing case member 15 for attachment of the device 10 to the wrist or ankle of an individual. The strap member has a buckle fastener member 55 for holding the first end 60 and second end 65 of the strap member 50 together about a wearer's wrist or ankle in a fastened state, while allowing the first end 60 and second end 65 of the strap member 50 to be separated for removal of the strap member 50 and attached housing case member 15 from the wearer's wrist or ankle with the buckle fastener member 55 in a loosened state.

A smoke detector member 70 is positioned within the housing case member 15 and powered by the battery power source member 45. The smoke detector member 70 has an opening to the housing case member front surface 20 where the detector member 70 continuously samples the air. The smoke detector member 70 operates to detect the products of combustion from a fire in the sampled air. The smoke detector member 70 may be either an optical detector for detecting combustion products or an ionization detector for this purpose. Both types of smoke detectors are well known in the industry. When smoke is detected by the smoke detector member 70, an audible alarm generating member 75 within the housing case member 15, powered by the battery power source 40, is automatically activated by the smoke detector member 70. The audible alarm generating member 75 likewise has an opening to the housing case member front surface 20 from which the audible alarm emanates. As shown in FIGS. 1 and 2, the smoke detector member opening and the audible alarm generating member opening may be adjacent to each other and covered with a protective grating member 80.

Figure 5:
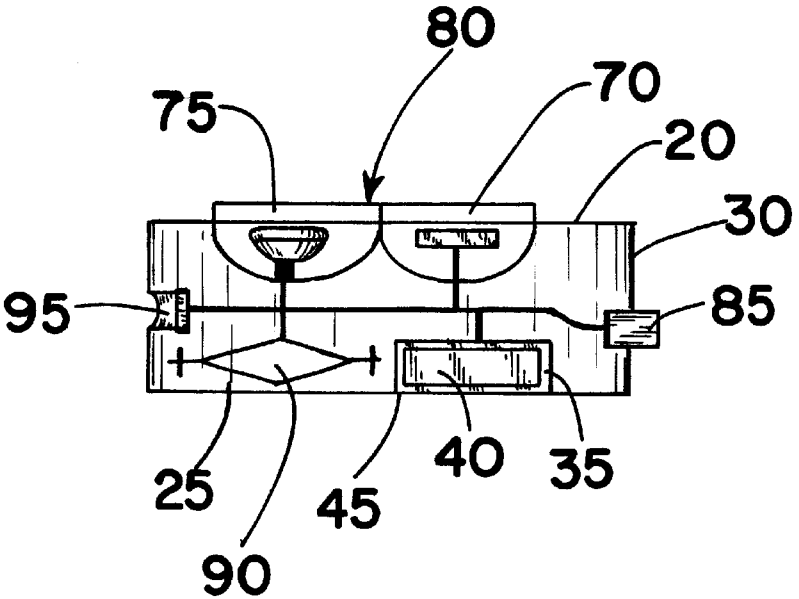
FIG. 5 is a cross sectional view of the device of FIG. 3 along the line 5–5'.
Figure 4:
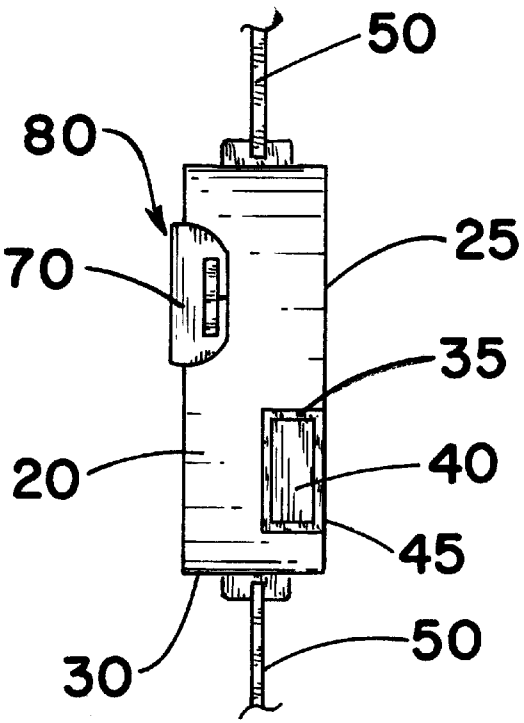
FIG. 4 is a cross sectional view of the device of FIG. 2 along the line 4–4'.

In addition, a silent alarm activating button member 85 is present on the housing case member 15. Pushing the silent alarm activating button member 85 by the wearer activates a silent alarm generating member 90 contained in the housing case member 15 which is powered by the battery power source 40. Preferably, the silent alarm activating button member 85 is positioned on the peripheral side surface 30 of the housing case member 15 for easy access. The silent alarm generating member 90 preferably produces a trackable radio signal that can be used by authorities to determine the location of the individual wearing the device 10. Such a radio signal tracking device is well known in the industry and readily available to authorities. Also present is an alarm deactivating button member 95 on the housing case member 15 which deactivates both the silent alarm generating member 90 and the audible alarm generating member 75 therein. Preferably, the alarm deactivating button member 95 is also positioned on the peripheral side surface 30 of the housing case member 15. Most preferably, the alarm deactivating button member 95 is recessed into the peripheral edge 30 of the housing case member 15. These features of the present invention are best understood by reference to FIGS. 4 and 5 which show cross sectional views of the housing case member 15 along lines 4–4' and 5–5', respectively. The alarm deactivating button member 95 functions to deactivate both the silent alarm generating member 85 and the audible alarm generating member 75. The alarm deactivating button member 95 is recessed to prevent inadvertent deactivation of either of the alarms, as well as to make deactivation difficult should an attacker attempt to harm or abduct the alarm device wearer.

Figure 6:
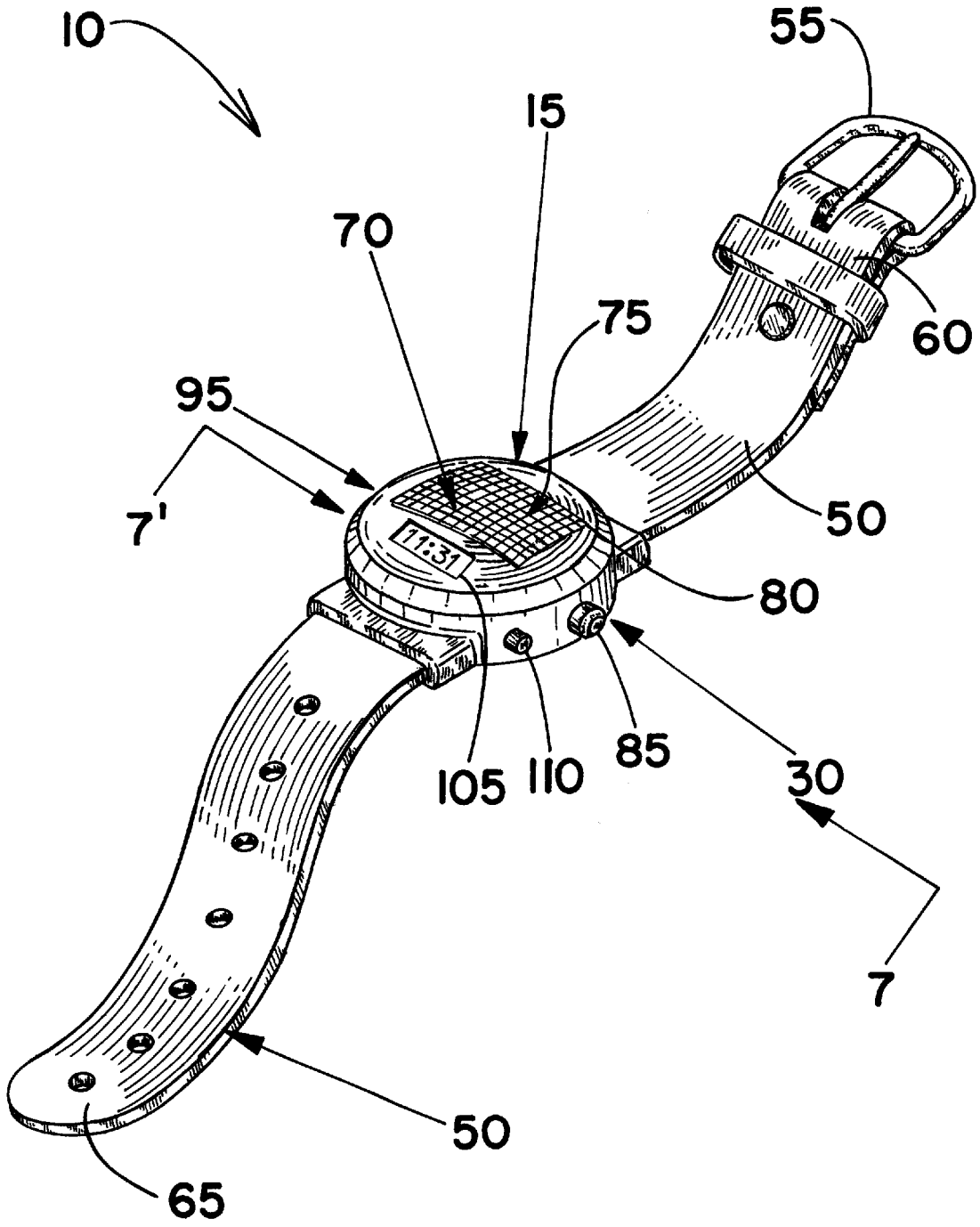
FIG. 6 is a perspective view of an alternative embodiment of the of the present invention.
Figure 7:
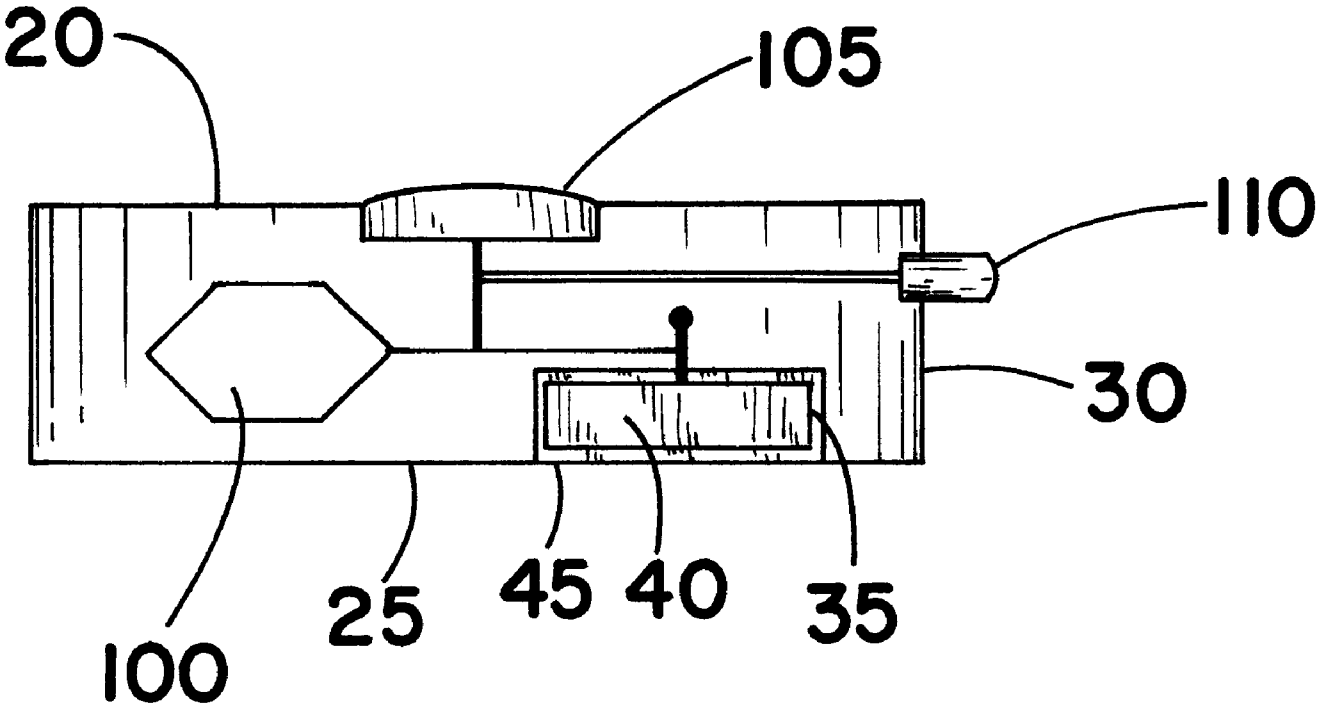
FIG. 7 is a cross sectional view of the embodiment of FIG. 6 along the line 7–7'.

In a further embodiment of the personal protection device 10, an electric clock mechanism member 100 is located within the housing case member 15, as seen in FIG. 6. The electric clock mechanism member 100 is powered by the battery power source member 40 within the device 10 and includes a time display means 105. The clock mechanism member 100 also includes a clock mechanism control switch member 110, positioned on the peripheral side surface 30 of the housing case member 15. The clock mechanism control switch member 110 is employed to adjust the time of day display 105 to the correct value, The time display 105 is preferably digital for ease in reading the time of day. The elements of this further embodiment are best seen in FIG. 7 which shows a cross sectional view of the housing case member 15 along line 7–7' of FIG. 6.

While the invention has been particularly shown and described with reference to preferred embodiments thereof, it will be understood by those skilled in the art that various changes in form and details may be made therein without departing from the spirit and scope of the invention.

I claim:

1. A personal protection device for attachment to an individual comprising;

(a) a housing case member with a battery compartment having an access opening thereto;

(b) a battery power source member within the battery compartment;

(c) a strap member for attachment of the housing case member to an individual;

(d) a smoke detector member within the housing case member powered by the battery power source;

(e) an audible alarm generating member within the housing case member powered by the battery power source, the audible alarm generating member actuated by the smoke detector member;

(f) a silent alarm generating member within the housing case member powered by the battery power source;

(g) a silent alarm actuating button member on the housing case member which actuates the silent alarm generating member therein; and (h) an alarm deactivating button member on the housing case member which deactivates both the silent alarm generating member and the audible alarm generating member therein.

2. The personal protection device according to claim 1, wherein the housing case member includes a cylindrical, flat member having front and back surfaces and a peripheral side surface, with the access opening to the battery compartment located on the cylindrical, flat member back surface.

3. The personal protection device according to claim 1, wherein the strap member includes a fastener holding a first end and a second end of the strap member together about a wearer's wrist in a fastened state and allowing the first end and the second end of the strap member to be separated for removal of the strap member and attached housing case member from the wearer's wrist in a loosened state.

4. The personal protection device according to claim 3, wherein the fastener holding a first and second end of the strap member together is a buckle.

5. The personal protection device according to claim 1, wherein the smoke detector member includes an optical detector for detecting combustion products.

6. The personal protection device according to claim 1, wherein the smoke detector member includes an ionization detector for detecting combustion products.

7. The personal protection device according to claim 1, wherein the silent alarm generating member produces a radio signal useable for determining the location of an individual wearing the personal protection device.

8. The personal protection device according to claim 2, wherein the silent alarm actuating button member and the silent alarm deactivating button are positioned on the peripheral side surface of the housing case member.

9. The personal protection device according to claim 1, wherein the silent alarm deactivating button is recessed into the housing case member.

10. The personal protection device according to claim 1, further including an electric clock mechanism member within the housing case member, the electric clock mechanism member including a time display means, the clock mechanism member powered by the battery power source member therein, the time display means located on the front surface of the housing case member.

11. The personal protection device according to claim 10, wherein the time display means is a digital time display.

12. The personal protection device according to claim 10, further including a clock mechanism member control switch positioned on the peripheral side surface of the housing case member.

13. A personal protection device for attachment to an individual comprising;

(a) a housing case member including a cylindrical, flat member having front and back surfaces and a peripheral side surface, the housing case member with an access opening on the cylindrical, flat member back surface to a battery compartment therein;

(b) a battery power source member within the battery compartment;

(c) a strap member for attachment of the housing case member to an individual;

(d) a smoke detector member within the housing case member powered by the battery power source;

(e) an audible alarm generating member within the housing case member powered by the battery power source, the audible alarm generating member actuated by the smoke detector member;

(f) a silent alarm generating member within the housing case member powered by the battery power source;

(g) a silent alarm actuating button member on the housing case member which actuates the silent alarm generating member therein;

(h) an alarm deactivating button member on the housing case member which deactivates both the silent alarm generating member and the audible alarm generating member therein; and (i) an electric clock mechanism member within the housing case member, the electric clock mechanism member including a time display means, the clock mechanism member powered by the battery power source member therein, the clock mechanism member including a control switch positioned on the peripheral side surface of the housing case member.

14. The personal protection device according to claim 13, wherein the strap member includes a buckle fastener holding a first end and a second end of the strap member together about a wearer's wrist in a fastened state and allowing the first end and the second end of the strap member to be separated for removal of the strap member and attached housing case member from the wearer's wrist in a loosened state.

15. The personal protection device according to claim 13, wherein the smoke detector member includes an optical detector for detecting combustion products.

16. The personal protection device according to claim 13, wherein the smoke detector member includes an ionization detector for detecting combustion products.

17. The personal protection device according to claim 13, wherein the time display means is a digital time display on the front surface of the housing case member.

18. The personal protection device according to claim 13, wherein the silent alarm actuating button member and the alarm deactivating button member are positioned on the peripheral side surface of the housing case member with the alarm deactivating button member recessed into the housing case member.

19. A personal protection device for attachment to an individual comprising;

(a) a housing case member including a cylindrical, flat member having front and back surfaces and a peripheral side surface, the housing case member with an access opening on the cylindrical, flat member back surface to a battery compartment therein;

(b) a battery power source member within the battery compartment;

(c) a strap member for attachment of the housing case member to an individual;

(d) a smoke detector member within the housing case member powered by the battery power source;

(e) an audible alarm generating member within the housing case member powered by the battery power source, the audible alarm generating member actuated by the smoke detector member;

(f) a silent alarm generating member within the housing case member powered by the battery power source, the silent alarm generating member producing a radio signal usable for determining the location of an individual wearing the personal detection device;

(g) a silent alarm actuating button member on the peripheral side surface of the housing case member which actuates the audible alarm generating member therein;

(h) an alarm deactivating button member recessed into the peripheral side surface of the housing case member which deactivates both the silent alarm generating member and the audible alarm generating member therein; and (i) an electric clock mechanism member within the housing case member, the electric clock mechanism member including a time display, the clock mechanism member means powered by the battery power source member therein, the clock mechanism member including a control switch positioned on the peripheral side surface of the housing case member and the time display means positioned on the front surface of the housing case member.

20. The personal protection device according to claim 19, wherein the time display means is a digital time display on the front surface of the housing case member.

* * * * *